US007749378B2

(12) United States Patent
Iqbal et al.

(10) Patent No.: US 7,749,378 B2
(45) Date of Patent: Jul. 6, 2010

(54) BITUMEN PRODUCTION-UPGRADE WITH COMMON OR DIFFERENT SOLVENTS

(75) Inventors: Rashid Iqbal, Houston, TX (US); Anshumali, Mobile, AL (US); Raymond H. Floyd, Katy, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1290 days.

(21) Appl. No.: 11/160,366

(22) Filed: Jun. 21, 2005

(65) Prior Publication Data

US 2006/0283776 A1 Dec. 21, 2006

(51) Int. Cl.
*C10C 3/08* (2006.01)

(52) U.S. Cl. ..... 208/309; 208/45; 208/251 R; 208/263

(58) Field of Classification Search ..... 208/309, 208/45, 251 R
See application file for complete search history.

(56) References Cited

U.S. PATENT DOCUMENTS

| | | | | |
|---|---|---|---|---|
| 2,069,515 | A | 2/1937 | Kovalsky | 257/230 |
| 2,446,040 | A * | 7/1948 | Blair, Jr. | 516/143 |
| 2,940,920 | A | 6/1960 | Garwin | 208/45 |
| 3,925,189 | A | 12/1975 | Wicks, III | 208/11 |
| 3,975,396 | A | 8/1976 | Bushnell et al. | |
| 4,039,429 | A | 8/1977 | Van Klinken et al. | |
| 4,160,718 | A | 7/1979 | Rendall | 208/390 |
| 4,191,639 | A | 3/1980 | Audeh et al. | |
| 4,200,519 | A | 4/1980 | Kwant et al. | |
| 4,290,880 | A | 9/1981 | Leonard | |
| 4,324,651 | A | 4/1982 | Rollmann et al. | |
| 4,347,118 | A | 8/1982 | Funk et al. | 208/390 |
| 4,354,922 | A | 10/1982 | Derbyshire et al. | |
| 4,354,928 | A | 10/1982 | Audeh et al. | |
| 4,421,639 | A | 12/1983 | Lambert et al. | |
| 4,424,112 | A | 1/1984 | Rendall | 208/390 |
| 4,440,633 | A | 4/1984 | Jacquin et al. | |
| 4,482,453 | A | 11/1984 | Coombs et al. | |
| 4,502,950 | A | 3/1985 | Ikematsu et al. | |
| 4,525,269 | A | 6/1985 | Ikematsu et al. | |
| 4,547,292 | A | 10/1985 | Zarchy | |
| 4,810,367 | A | 3/1989 | Chombart et al. | |
| 4,875,998 | A | 10/1989 | Rendall | 208/390 |
| 4,915,819 | A * | 4/1990 | Chirinos et al. | 208/309 |
| 4,933,067 | A | 6/1990 | Rankel | |
| 5,046,559 | A | 9/1991 | Glandt | 166/248 |
| 5,089,114 | A | 2/1992 | Tovar et al. | |
| 5,192,421 | A | 3/1993 | Audeh et al. | |
| 5,215,146 | A | 6/1993 | Sanchez | 166/277.3 |
| 5,318,124 | A | 6/1994 | Ong et al. | 166/277.3 |
| 5,656,152 | A * | 8/1997 | McLaughlin et al. | 208/95 |
| 5,843,303 | A | 12/1998 | Ganeshan | 208/309 |
| 5,914,010 | A | 6/1999 | Hood et al. | |
| 5,919,355 | A | 7/1999 | Hood | |

(Continued)

*Primary Examiner*—Tam M Nguyen
(74) *Attorney, Agent, or Firm*—KBR IP Legal

(57) ABSTRACT

Disclosed is a process for the upgrading of heavy oils and bitumens, where the total feed to the process can include heavy oil or bitumen, water, and diluent. The process can include the steps of solvent deasphalting 110 the total feed 105 to recover an asphaltene fraction 116, a deasphalted oil fraction 118 essentially free of asphaltenes, a water fraction 112, and a solvent fraction 114. The process allows removal of salts from the heavy oils and bitumens either into the aqueous products or with the asphaltene product.

15 Claims, 3 Drawing Sheets

U.S. PATENT DOCUMENTS 6,274,032 B2 8/2001 Hood et al.
6,332,975 B1 12/2001 Abdel-Halim et al.
6,357,526 B1 3/2002 Abdel-Halim et al. ... 166/277.3
6,524,469 B1 2/2003 Schucker
6,533,925 B1 3/2003 Wallace et al.
7,144,498 B2 12/2006 McCall et al.
2003/0188995 A1 * 10/2003 Varadaraj ..... 208/251 R

* cited by examiner

BITUMEN PRODUCTION-UPGRADE WITH COMMON OR DIFFERENT SOLVENTS

BACKGROUND OF THE INVENTION

The present invention generally relates to the upgrading of heavy oils and bitumens. More particularly, the present invention relates to a process for the upgrading of heavy oils and bitumens including one or more of the steps of production, desalting, dewatering, fractionation, solvent extraction, delayed coking, thermal cracking, fluid catalytic cracking and hydrotreating and/or hydrocracking to produce synthetic crude and/or naphtha, distillate and gas oil streams.

Refiners continue to seek improved methods for processing and converting heavy crude oil resources into more useful oils and end products. The heavier crudes, which can include bitumens, bitumens from tar sands, and other heavy oils, pose processing problems due to the presence of salts, metals, and organic acids. Bitumens and heavy oils are extremely viscous, resulting in problems in transporting the raw materials by traditional means. Heavy oils and bitumens often must be maintained at elevated temperatures to remain flowable, and/or mixed with a lighter hydrocarbon diluent for pipeline transportation. The diluent can be expensive and additional cost is normally incurred in transporting it to the location where production is occurring.

Additionally, natural occurring water in the oils, commonly known as produced water, contains salts. This water is in some processes vaporized to meet pipeline specifications for water content. Salts are thus left in the oil and then transported with the heavy oil or bitumen or with the solvent diluted heavy oil or bitumen.

FIG. 1 illustrates one of the process schemes for the processing of heavy oil or bitumen to convert into and recover useful hydrocarbon products. A heavy crude oil or bitumen feed 10 produced from a well, by an in-situ production method such as steam assisted gravity drainage (SAGD) or by a mining operation, can be mixed with a diluent to keep the mixture viscosity in a desired range for transport to a refinery or other facility for processing, and can also include water, salts, metals, silt, etc. Total feed 10 is ideally first processed to remove the water and salt from the hydrocarbons in desalter 12; the water and salt can be recovered via stream 14.

The hydrocarbons can be recovered in stream 16 and fed to crude or atmospheric distillation unit 18 to recover the diluent 20 and to obtain straight run naphtha, distillates, gas oil, and the like, recovered in stream 22. Diluent 20 can be recovered and returned to heavy oil or bitumen production or mining facilities via a pipeline. The atmospheric tower bottoms (ATB) residue 24 is usually further processed to increase the yield of the more valuable products, e.g. naphtha, distillates and gas oil. The ATB residue 24 may contain a large proportion of hydrocarbons boiling above 565° C. (1050° F.), as well as nitrogen, sulfur, and organometallic compounds, and Conradson carbon residue (CCR), and can be difficult to process. Frequently, a vacuum distillation tower 26 is employed to recover additional vacuum gas oil 28 from the ATB residue 24. The vacuum tower bottoms (VTB) residue 30 is even more concentrated in high-boiling hydrocarbons, e.g. normally boiling at greater than 565° C. (1050° F.), as well as CCR, sulfur, nitrogen and organometallic compounds.

In typical refinery processing with a vacuum distillation tower 26, the VTB residue 30 (and/or the ATB residue 24) can be fed to solvent deasphalting 32 (SDA). The solvent deasphalting 32 contacts the residue with propane, butane, pentane, hexane, or a combination thereof, or a like solvent (at either subcritical or supercritical conditions, e.g. residuum oil supercritical extraction or ROSE®; other SDA processes can include DEMEX and SOLVAHL, or conventional solvent deasphalting) to separate the asphaltenes 34 from deasphalted oil (DAO) 36 (and/or resins). The DAO 36 has lower levels of CCR, sulfur, nitrogen, and metals than the atmospheric resid/vacuum resid feed since these constituents are disproportionately retained with the asphaltenes 34.

The products 22, 28 obtained from the atmospheric tower 18 and vacuum tower 26, as well as DAO 36 from the solvent deasphalting 32, can be combined to form distillate stream 38. Distillate stream 38 or the individual product streams 22, 28, 36 are usually further processed to upgrade the hydrocarbons and remove additional nitrogen and sulfur in order to facilitate processing in catalytic cracking units, hydrotreating and hydrocracking units of any type, and the like, without prematurely poisoning their catalysts.

The typical FIG. 1 process for the separation and upgrading of heavy oil or bitumen feed into useful products involves several processing steps and can require a substantial capital investment. Additionally, the bitumen or heavy oil feed can include acidic species. Any acid in the bitumen or heavy oil feed can also require the use of expensive metallurgy in fractionation equipment usually operating above 232° C. (450° F.).

In U.S. Pat. No. 4,875,998, Rendall discloses the extraction of bitumen oils from tar-sands with hot water. Other water or solvent extraction processes are disclosed in U.S. Pat. No. 4,160,718 to Rendall; U.S. Pat. No. 4,347,118 to Funk, et al.; U.S. Pat. No. 3,925,189 to Wicks, III; and U.S. Pat. No. 4,424,112 to Rendall.

Other representative references directed to the production of crude petroleum from tar sands include Canadian Patent Application 2,069,515 by Kovalsky; U.S. Pat. No. 5,046,559 to Glandt; U.S. Pat. No. 5,318,124 to Ong et al; U.S. Pat. No. 5,215,146 to Sanchez; and Good, "Shell/Aostra Peace River Horizontal Well Demonstration Project," $6^{th}$ UNITAR Conference on Heavy Crude and Tar Sands (1995).

Solvent extraction of the residuum oil has been known since the 1930's, as previously described in U.S. Pat. No. 2,940,920, to Garwin. Other representative solvent deasphalting techniques using supercritical solvent conditions are described, for example, in publications such as Northup et al., "Advances in Solvent Deasphalting Technology," presented at the 1996 NPRA Annual Meeting, San Antonio, Tex., Mar. 17-19, 1996, and Nelson et al., "ROSE®: The Energy-Efficient, Bottom-of-the-Barrel Alternative," presented at the 1985 Spring AIChE Meeting, Houston, Tex., Mar. 24-25, 1985, all of which are incorporated herein by reference. Improved techniques in solvent extraction have been disclosed in U.S. Pat. No. 5,843,303 to Ganeshan. U.S. Pat. No. 6,357,526 discloses a process and system which integrates on-site heavy oil or bitumen upgrading and energy recovery for steam production with steam-assisted gravity drainage (SAGD) production of the heavy oil or bitumen which is maintained at elevated temperature for pumping to the upgrading unit.

SUMMARY OF THE INVENTION

The process of the present invention can decrease the capital investment required, decrease operating expenses, improve operating reliability and can greatly simplify the processing steps needed to process a total feed from heavy oil or bitumen from mining or SAGD, or other in-situ production methods. The invention can use a diluent to transport the heavy oil or bitumen to a solvent deasphalting unit, which can conveniently use the diluent as the deasphalted oil (DAO)

extraction solvent. Solvent recovered within the deasphalting unit is then returned to the heavy oil or bitumen production site for use as a diluent. Alternately the invention can use a blend of solvents for deasphalting oil, for example where one of the blend components can be the diluent used to transport the heavy oil or bitumen. The solvent can, when needed, be fractionated to recover diluent for return to the production site. The present invention can process the total heavy oil or bitumen feed, thus eliminating the need for front-end desalting and fractionation. Desalting and water separation in one embodiment can be effected in a modified solvent deasphalting operation.

In one embodiment, the present invention provides an integrated process for transporting and upgrading heavy oil or bitumen, comprising: diluting the heavy oil or bitumen with a diluent comprising a hydrocarbon having from 3 to 8 carbon atoms primarily for the purpose of forming a pumpable mixture, e.g. at ambient pipeline temperature conditions; transporting the mixture, e.g. via pipeline, to a solvent deasphalting unit that can be at a remote location; solvent deasphalting the mixture to recover an asphaltene fraction, a deasphalted oil fraction essentially free of asphaltenes, and a solvent fraction comprising said diluent; recycling where required a portion of the recovered solvent as the diluent for the heavy oil or bitumen.

The heavy oil or bitumen can have an API gravity from 2 to 15. The heavy oil or bitumen can have a total acid number of between 0.5 and 6. The heavy oil or bitumen can have a basic sediment and water (BS&W) content from 0.1 to 6 weight percent. The heavy oil or bitumen can contain more than 1.4 g chloride salt per m3 (0.5 g per 1000 42-gallon barrels of crude), or more than 2.85 g/m3 chloride salt (1 g per 1000 42-gallon barrels of crude) in another embodiment.

As used herein, "essentially free of" a component means having less than 0.1 weight percent of that component, or less than 0.01 weight percent in another embodiment. For example, "essentially free of water" means less than 0.1 weight percent water, or less than 0.01 weight percent.

The heavy oil or bitumen can contain water, and the solvent deasphalting can include sour water recovery wherein the deasphalted oil fraction is essentially free of water. The heavy oil or bitumen can also contain chloride salts, and the solvent deasphalting can include desalting downstream from an asphaltene separator wherein the deasphalted oil fraction is essentially free of chloride salts. In one embodiment, the process can comprise injecting water into the mixture at or upstream from the solvent deasphalting to facilitate the desalting.

In one embodiment the asphaltene separation, the deasphalted oil separator, and solvent stripping of deasphalted oil during the solvent deasphalting can occur at a temperature of 232° C. (450° F.) or less, decreasing organic acid attack and minimizing the need for high alloy metals in the solvent deasphalting equipment.

The diluted heavy oil or bitumen can have a ratio of from 1 to 10 parts by weight diluent per part by weight heavy oil or bitumen. The solvent deasphalting can have a ratio of from 1 to 10 parts by weight solvent per part by weight heavy oil or bitumen.

The solvent can be a hydrocarbon having 3 to 8 carbon atoms or a combination thereof. In another embodiment, the solvent can be a hydrocarbon having 4 to 7 carbon atoms or a combination thereof, e.g. naphtha. In another embodiment, the solvent can be a hydrocarbon having 5 or 6 carbon atoms or a combination thereof. The process of the present invention can operate without desalting the heavy oil or bitumen upstream from the solvent deasphalting. The solvent deasphalting can operate on total heavy oil or bitumen feed without any pretreatment.

In another embodiment, the present invention provides a process for upgrading a total feed comprising heavy oil or bitumen with solvent and water, comprising: supplying the total feed to an asphaltene separator at asphaltene separation conditions to produce an asphaltene-rich stream and an asphaltene-lean stream; stripping solvent from the asphaltene-rich stream to form an asphaltene fraction essentially free of water and recover a first solvent stream to a solvent recovery system; separating the asphaltene-lean stream in a deasphalted oil separator to form a deasphalted oil stream and recover a second solvent stream to the solvent recovery system; stripping solvent from the deasphalted oil stream to form a deasphalted oil fraction essentially free of water and recover a third solvent stream to the solvent recovery system; separating water from the solvent recovery system; and recovering water from the deasphalted oil separator, the deasphalted oil stream, or a combination thereof.

The total feed can comprise heavy oil or bitumen with an API gravity from 2 to 15 on a solvent free basis. The total feed can have a total acid number between 0.5 and 6 on a solvent free basis. The total feed can have a basic sediment and water content from 0.1 to 6 weight percent on a solvent free basis. The total feed can comprise chloride salts.

The water recovery can include cooling the deasphalted oil stream and recovering an aqueous phase prior to the solvent stripping of the deasphalted oil stream. In another embodiment, the chloride salts are removed with the recovered aqueous phase. In another embodiment, chloride salts are recovered with the asphaltene fraction.

The process of the present invention can include recycling solvent from the solvent recovery system through a solvent recycle line to the asphaltene separator. The solvent recovery system can include a solvent return line from the second solvent stream, through a cross-exchanger for heating the asphaltene-lean stream, and to the solvent recycle line.

The water recovery can include cooling solvent in the solvent return line and recovering a water stream by phase separation upstream from the solvent recycle line. The process of the present invention can include recovering a water-rich stream from the deasphalted oil separator.

The solvent stripping from the asphaltene-rich stream and the deasphalted oil stream can comprise steam stripping. The total feed can include hydrogen sulfide, and the recovered water, separated water or both can include hydrogen sulfide.

The process of the present invention can further include the steps of pipelining solvent from the solvent recovery system to heavy oil or bitumen production at a remote location, diluting the heavy oil or bitumen with the excess solvent to form the total feed, and pipelining the total feed to the asphaltene separator.

The process can include adding water into the total feed upstream from the asphaltene separator. The solvent can be a hydrocarbon having from 3 to 8 carbon atoms or a combination thereof. In other embodiments, the solvent can be a hydrocarbon having 4 to 7 carbon atoms, or 5 to 6 carbon atoms, or a combination thereof.

The present invention also provides an apparatus for upgrading a total feed comprising heavy oil or bitumen with solvent and water, comprising: means for supplying the total feed to an asphaltene separator at asphaltene separation conditions to produce an asphaltene-rich stream and an asphaltene-lean stream; means for stripping solvent from the asphaltene-rich stream to form an asphaltene fraction essentially free of water and recover a first solvent stream to a solvent recovery system; means for separating the asphaltene-lean stream in a deasphalted oil separator to form a deasphalted oil stream and recover a second solvent stream to the solvent recovery system; means for stripping solvent from the deasphalted oil stream to form a deasphalted oil fraction essentially free of water and recover a third solvent stream to the solvent recovery system; means for separating water from the solvent recovery system; and means for recovering water from the deasphalted oil separator, the deasphalted oil stream, or a combination thereof.

BRIEF DESCRIPTION OF THE DRAWINGS

For a more detailed description of the illustrated embodiments of the present invention, reference will now be made to the accompanying drawings, wherein.

DETAILED DESCRIPTION OF THE INVENTION

The process of the present invention can decrease the required capital investment, decrease operating expenses, and greatly simplify the processing steps needed to process a total feed from heavy oil or bitumen mining or production, as will be readily ascertained by the following description. The process of the present invention can eliminate the desalter, atmospheric and vacuum distillation units, thus simplifying the overall processing scheme and reducing the capital required when constructing a plant.

The produced oil, heavy oil or bitumen, can be mixed with a diluent to produce easily transportable oil, where the diluent is also suitable as a solvent for solvent deasphalting. The diluent can be a hydrocarbon having 3 to 8 carbon atoms, or a combination thereof. The diluted heavy oil or bitumen can have a ratio of from 3 to 10 parts by weight diluent per part by weight heavy oil or bitumen.

In certain embodiments, the heavy oil or bitumen can have a basic sediment and water content (BS&W) from 0 to 6 weight percent or more, on a diluent free basis. In other embodiments, the heavy oil or bitumen can include salts, some of which are chloride salts, where the salt content of the heavy oil or bitumen is greater than 0.23 kg (0.5 pounds) of salt per 159 m3 (1000 barrels) of heavy oil or bitumen, on a diluent free basis. In other embodiments, the heavy oil or bitumen can include hydrogen sulfide.

Figure 1:
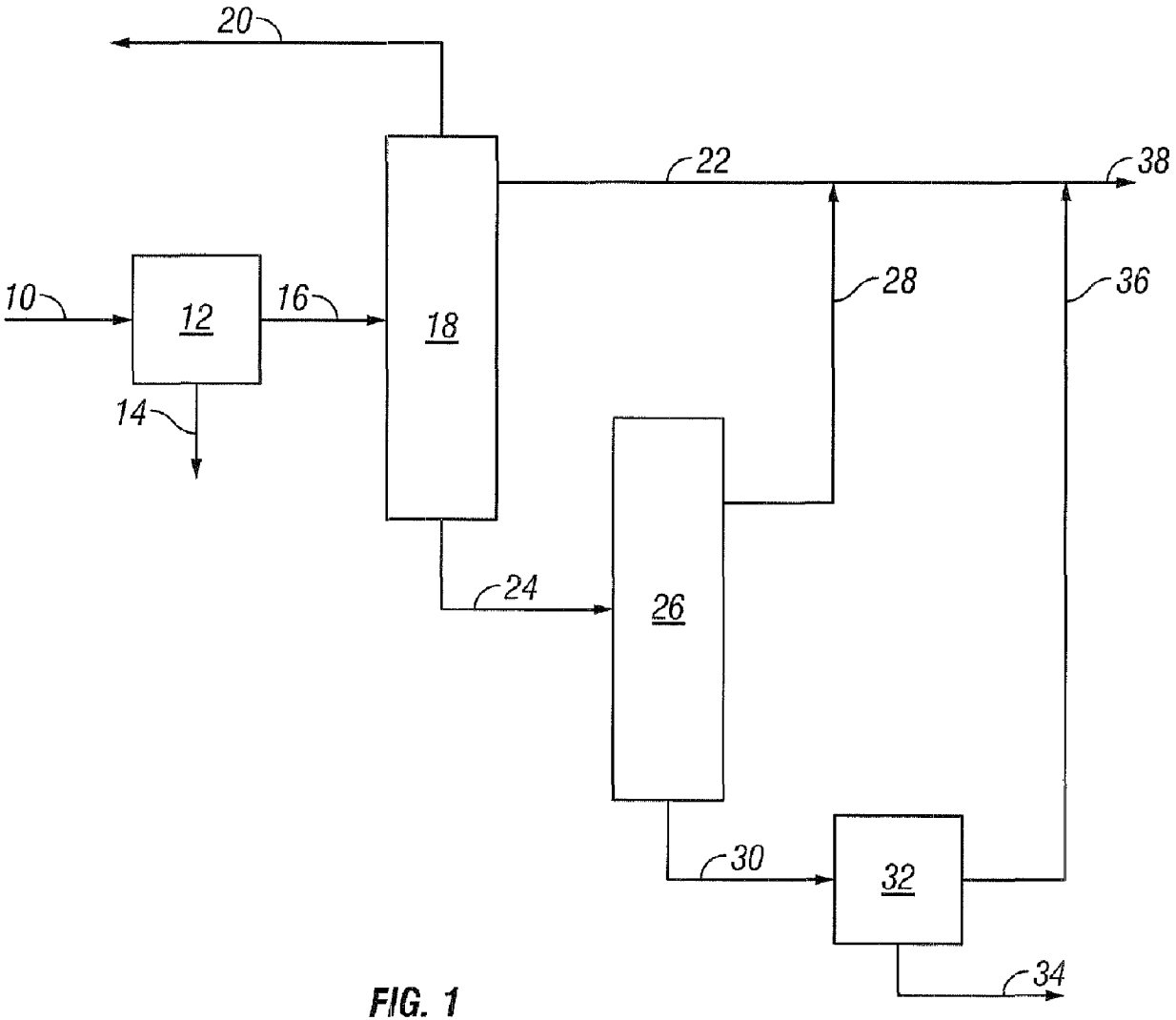
FIG. 1 (Prior Art)
FIG. 1 illustrates a typical prior art process flow diagram for processing bitumen and heavy oil.
Figure 2:
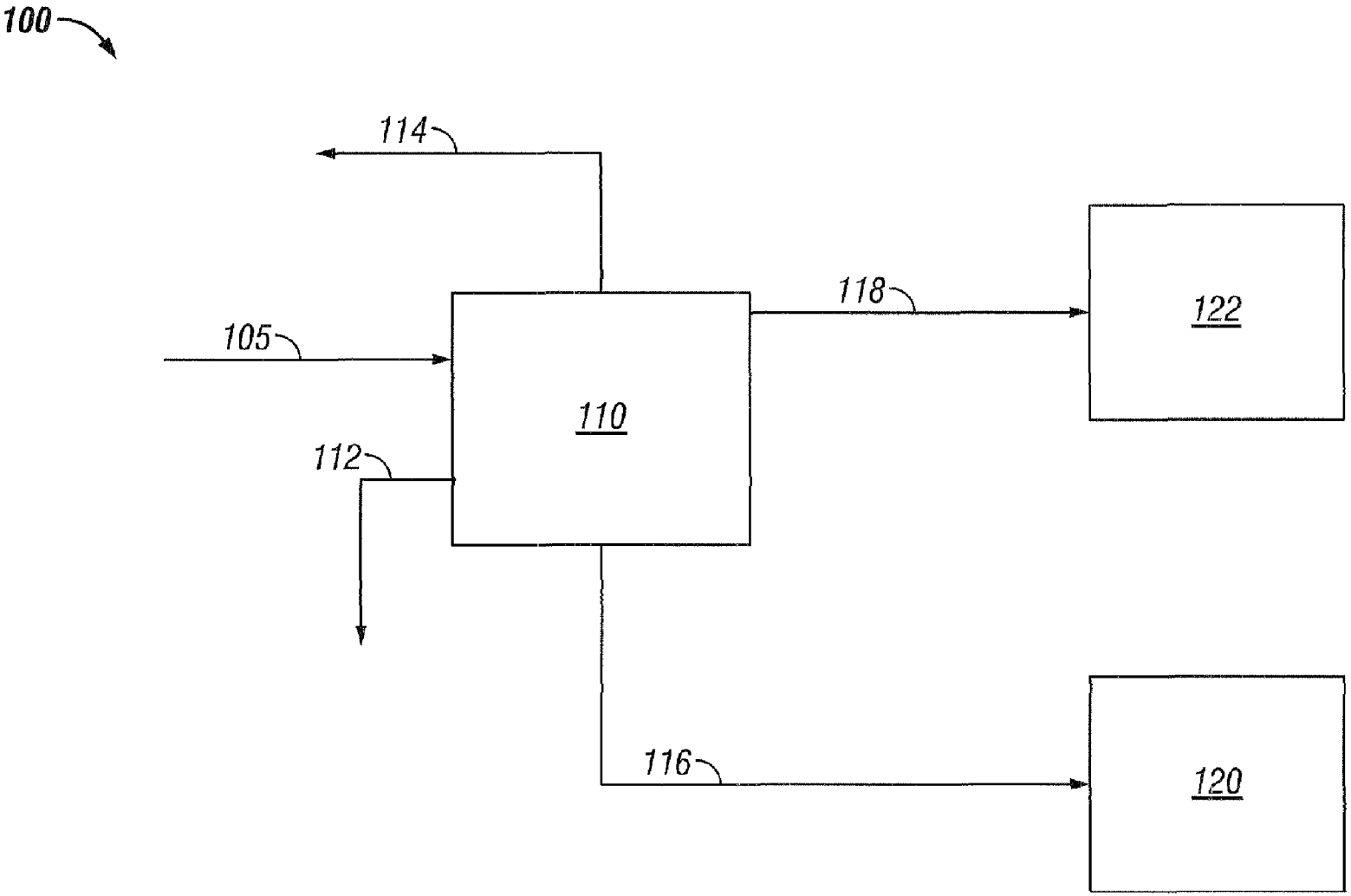
FIG. 2 shows a process according to one embodiment of the invention for the partial upgrading of heavy oil or bitumen feedstock utilizing a modified ROSE® process to process the total feed.

Referring to FIG. 2, in one embodiment of the process 100 of the present invention, a total feed 105 (including the produced oil, diluent, and any water, silt, and salts) can be fed directly to a solvent deasphalting unit 110.

Deasphalting unit 110 can separate the total feed 105 into water fraction 112, diluent fraction 114, asphaltene fraction 116, and deasphalted oil fraction 118. Solvent deasphalting unit 110 can operate at moderate temperatures (mostly less than 232° C. (450° F.), for example) and can effectively reduce the need for high metallurgy. The solvent deasphalting unit 110 can be conventional, employing equipment and methodologies for solvent deasphalting which are widely available in the art, for example, under the trade designations ROSE®, SOLVAHL, DEMEX, or the like, or can be a modified ROSE® process as described below with reference to FIG. 3.

Asphaltene fraction 116 can be forwarded to a process 120 where the asphaltene can be upgraded or otherwise advantageously used for energy generation. For example, asphaltenes 116 can be pelletized, used to produce asphalt, processed in a coker, gasification process, or combusted to produce steam, or made into asphalt for road pavement. Deasphalted oil fraction 118 can be forwarded to other upgrading processes (122) such as hydrotreating, hydrocracking fluid catalytic cracking units, visbreaking and thermal cracking processes, etc., or could simply be blended into fuel oil or other product streams. For a total feed 105 having a high metal content, the DAO can be supplied to an FCC unit having a low conversion activity catalyst for the removal of metals (see, for example, U.S. Ser. No. 10/711,176, filed Aug. 30, 2004 by Iqbal et al.).

Figure 3:
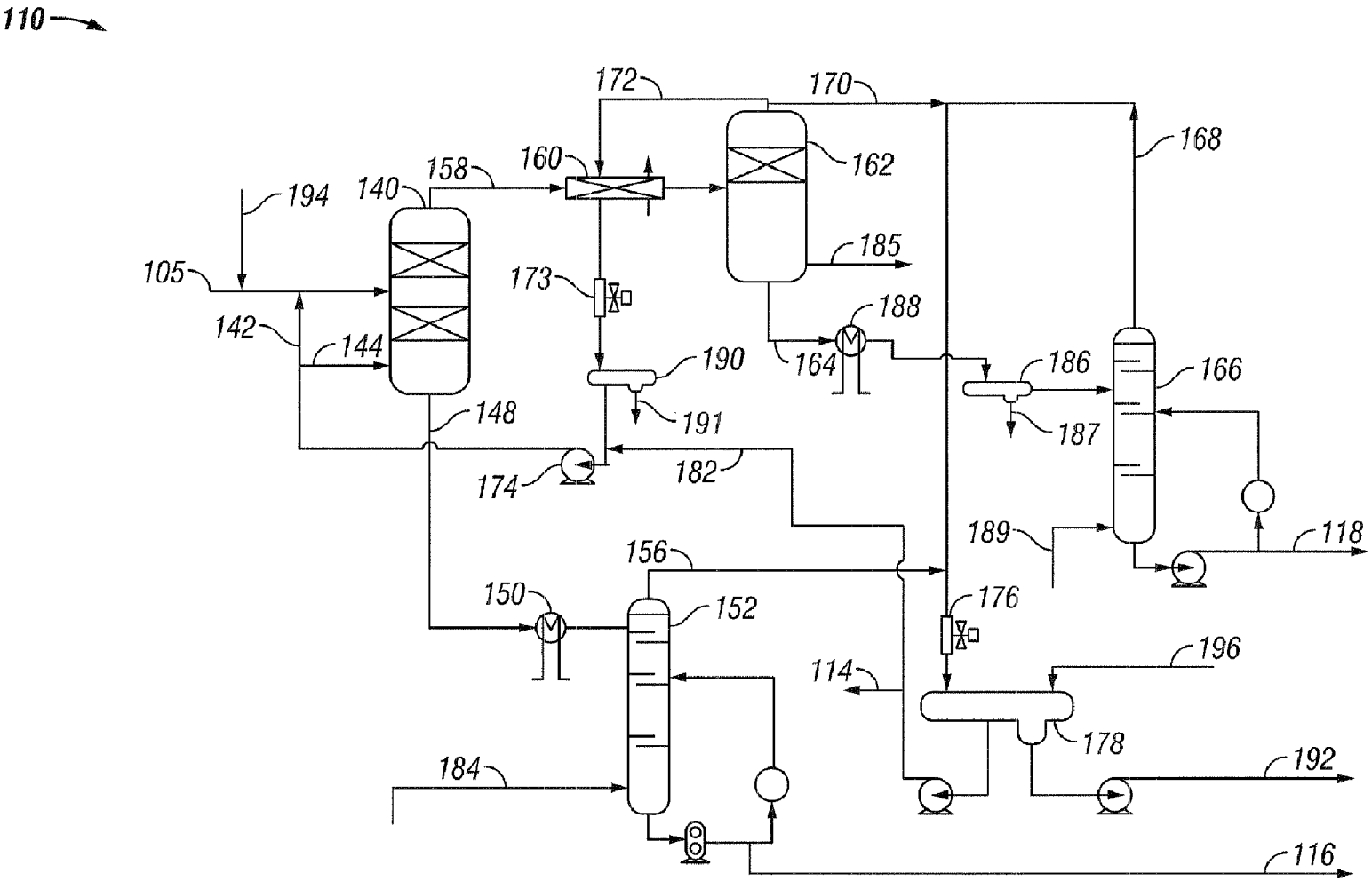
FIG. 3 shows a simplified flow diagram of the modified ROSE® process of FIG. 2.

FIG. 3 illustrates a simplified flow diagram of one embodiment of the modified solvent deasphalting unit 110. The total feed 105 is supplied to asphaltene separator 140. Additional diluent or solvent, if necessary, can be introduced via lines 142 and 144 into feed line 105 and asphaltene separator 140, respectively. If desired, all or part of the solvent can be introduced into the feed line 105 via line 142. If desired, a conventional mixing element 146 can be employed to mix in the solvent introduced from line 142.

The asphaltene separator 140 contains conventional contacting elements such as bubble trays, packing elements such as rings or saddles, structural packing such as that available under the trade designation ROSEMAX, or the like. In the asphaltene separator 140, the total feed 105 separates into a solvent/deasphalted oil (DAO) phase, and an asphaltene phase. The lighter solvent/DAO phase passes upwardly while the heavier asphaltene phase travels downwardly through separator 140. The asphaltene phase is collected from the bottom of the asphaltene separator 140 via line 148, heated in heat exchanger 150 and fed to flash tower or asphaltene stripper 152. The asphaltene phase is stripped of solvent in asphaltene stripper 152. The asphaltene is recovered as a bottoms product in line 116, and solvent vapor overhead in line 156.

The asphaltene separator 140 is maintained at an elevated temperature and pressure sufficient to effect a separation of the petroleum residuum and solvent mixture into a solvent/DAO phase and an asphaltene phase. Typically, asphaltene separator 140 can be maintained at a sub-critical temperature of the solvent and a pressure level at least equal to the critical pressure of the solvent.

The solvent/DAO phase can be collected overhead from the asphaltene separator 140 via line 158 and conventionally heated via heat exchanger 160, which can integrate heat recovery and conventional heat exchange as required. The heated solvent/DAO phase can be next supplied to DAO separator 162.

As is well known, the temperature and pressure of the solvent/DAO phase is manipulated to cause a DAO phase to separate from a solvent phase. The DAO separator 162 is maintained at an elevated temperature and pressure sufficient to effect a separation of the solvent/DAO mixture into solvent and DAO-rich phases. In the DAO separator 162, the heavier DAO phase passes downwardly while the lighter solvent phase passes upwardly. The DAO-rich phase is collected from the bottom of the DAO separator 162 via line 164. The DAO-rich phase is fed to flash tower or DAO stripper 166 where it is stripped to obtain a DAO product via bottoms line 118 and solvent vapor in overhead line 168. Solvent is recovered overhead from DAO separator 162 via line 170. A portion of the diluent recovered in line 170 can be fed to heat exchangers 160 via line 172 and cooled in heat exchangers 160, 173 for recirculation via pump 174 and lines 142, 144. The remaining diluent recovered in line 170 and the diluent recovered from vapor lines 156 and 168 can be condensed in heat exchanger 176, accumulated in surge drum 178 and recycled via pump 180 and line 182. Any excess diluent can be recovered via line 114 and can be returned to heavy oil or bitumen production or mining facilities via a pipeline.

The DAO separator 162 typically is maintained at a temperature higher than the temperature in the asphaltene separator 140. The pressure level in DAO separator 162 is maintained at least equal to the critical pressure of the solvent when maintained at a temperature equal to or above the critical temperature of the solvent. Particularly, the temperature level in DAO separator 162 is maintained above the critical temperature of the solvent.

Any water and salt entering with the total feed 105 can be processed in the asphaltene separator 140. Water will be proportioned into streams 148 and 158 based upon solubility of the water in the respective fractions (as a function of temperature, pressure, diluent type, and others). Water in asphaltene separator 140 bottoms stream 148 can be flashed overhead in asphaltene stripper 152 and collected in overhead stream 156 along with any steam supplied to stripper 152 via line 184.

Water in asphaltene separator 140 overhead stream 158 can be processed in DAO separator 162, and will be proportioned into streams 170, 164 based upon solubility of the water in the respective diluent and DAO fractions. If diluent recycle can result in a sufficient water concentration such that a water phase can form, water can be recovered via line 185 from the DAO separator 162; a water phase can also form in the diluent recycle system (lines 172, 170), or in the DAO bottoms stream.

If necessary, the portion of the water remaining with DAO separator bottoms stream 164 can be separated from the DAO in water separator 186 and recovered via line 187 prior to feeding the DAO separator 162 bottoms to the DAO stripper 166. For example, water separator 186 can be a flash separator or can be a liquid-liquid separator wherein the DAO separator bottoms stream 164 is cooled in heat exchanger 188 and phase separated in water separator 186 to recover water and chloride salts, if present, from the DAO via line 187. Water can also be flashed overhead in the DAO stripper 166, combined with any steam injected via line 189 into the DAO stripper 166, and recovered via line 168.

Any water produced overhead in DAO separator 162 can be collected in streams 170, 172. Stream 172 can be cooled in heat exchangers 160, 173, and, if necessary or desired, the water can be separated from the diluent in water separator 190 and recovered via line 191 prior to recycling the water via pump 174. Water in streams 156, 168, 170 can be removed in surge drum 178, with the water recovered via stream 192.

Foul water streams 185, 187, 191, 192 can be combined to form foul water fraction 112 (see FIG. 2). Water fraction 112 can include salts and hydrogen sulfide in total feed 105, as well as other components, such as a small amount of soluble hydrocarbons, for example.

Often, water is removed from the bitumen or heavy oil prior to transport in pipelines, with substantial salt remaining with the bitumen or heavy oil. If required, seed water stream 194 can be combined with a bitumen or heavy oil feed to form total feed stream 105, facilitating salt removal. Optionally, seed water stream 194 can be used to add additional water to total feed stream 105 to improve the water and salt separations achieved in water separators 186, 190.

As mentioned above, the produced oil can be mixed with a diluent to produce easily transportable oil, where the diluent is also suitable as a solvent for the solvent deasphalting process 110. If required, an initial charge or makeup solvent can be added to SDA 110 via line 196. Where the diluent supplied with the produced oil varies in composition or ratio from the solvent used in deasphalting process 110, the diluent can be replaced or its quality adjusted by blending with other hydrocarbons upstream or within the deasphalting process 110 and the ratio adjusted by including an internal solvent recycle stream within the deasphalting unit.

As an example of the process as described in FIG. 3, where stream 172 and related equipment are not included, a total feed 105, at a rate of 15,500 $m^3$/day (130,000 barrels (U.S., liquid) per day), contains 1 weight percent water, 27.5 weight percent asphaltene, and 71.5 weight percent DAO. The required solvent to oil ratio for proper deasphalting can be achieved by mixing the feed with recycle solvent streams 142 and 144, comprising 2.3 weight percent water and 97.7 weight percent C5's. The combined stream, having 5.4 weight percent asphaltene, 14.1 weight percent DAO, 78.4 weight percent diluent, and 2 weight percent water, can be fed to asphaltene separator 140, operating at a temperature range of between 149-204° C. (300-400° F.) and a pressure of between 2-7 MPa (290-1015 psia), resulting in asphaltene-rich stream 148 and DAO-rich stream 158. Asphaltene-rich stream 148 can have approximately 73.8 weight percent asphaltene, 0.007 weight percent water, and 25.5 weight percent diluent. DAO-rich stream 158 can have approximately 15.3 weight percent DAO, 2.1 weight percent water, and 82.5 weight percent diluent.

Asphaltene-rich stream 148 can be fed to asphaltene stripper 152, operating at a temperature range of between 176-288° C. (350-550° F.) and a pressure of between 0.05-0.2 MPa (7-29 psia), resulting in asphaltene stripper overhead stream 156, having approximately 2.6 weight percent water and 97.4 weight percent diluent, exclusive of any steam used in the stripping process; the asphaltene can be recovered in stream 116 essentially free of diluent and water.

DAO rich stream 158 can be heated in heat exchanger 160 and fed to DAO separator 162, operating at a temperature range of between 176-260° C. (350-500° F.) and a pressure of between 2-7 MPa (290-1015 psia), resulting in DAO separator bottoms stream 164, having approximately 71.7 weight percent DAO, 27.6 weight percent diluent, and 0.7 weight percent water. DAO separator overhead stream 170 can comprise approximately 2.5 weight percent water and 97.5 weight percent diluent. Stream 164 can be fed to DAO stripper 166, operating at a temperature range of between 176-260° C. (350-550° F.) and a pressure of between 0.05-0.2 MPa (7-29 psia), resulting in DAO stripper overhead stream 168, having approximately 2.5 weight percent water and 97.5 weight percent diluent, exclusive of any steam used in the stripping process; the DAO can be recovered in stream 118 essentially free of diluent and water.

Solvent-rich streams 156, 168, 170 can be collected and cooled in heat exchanger 176. The resulting stream can be received in water separator 178, where a fraction of the water can be recovered, and the remaining water and solvent recycled in stream 142.

All patents, patent applications, and other documents referred to herein are hereby incorporated by reference in their entirety for purposes of U.S. patent practice and other jurisdictions where permitted.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. An integrated process for transporting and upgrading heavy oil or bitumen, comprising:

diluting the heavy oil or bitumen at a production site with a diluent comprising a hydrocarbon having from 3 to 8 carbon atoms to form a mixture;

transporting the mixture from the production site to a solvent deasphalting unit;

deasphalting the mixture in the solvent deasphalting unit to recover an asphaltene fraction, a deasphalted oil fraction essentially free of asphaltenes, and a solvent fraction;

separating water and salts from the asphaltene fraction, the deasphalted oil fraction, and the solvent fraction at the solvent deasphalting unit; and conveying at least a portion of the solvent fraction to the production site to dilute the heavy oil or bitumen and form the mixture.

2. The process of claim 1 wherein the heavy oil or bitumen has an API gravity from 2 to 15.

3. The process of claim 1 wherein the heavy oil or bitumen has a total acid number between 0.5 and 6.

4. The process of claim 1 wherein the heavy oil or bitumen has a basic sediment and water content from 0.1 to 6 weight percent.

5. The process of claim 1 further comprising injecting water into the mixture at or upstream from the solvent deasphalting unit to facilitate removal of chloride salts.

6. The process of claim 1 wherein the solvent deasphalting of the mixture occurs at a temperature not exceeding 232° C.

7. The process of claim 1 wherein the dilution of the heavy oil or bitumen comprise a ratio of from 1 to 10 parts by weight diluent per part by weight heavy oil or bitumen.

8. The process of claim 1 wherein the solvent deasphalting is at a ratio of from 1 to 10 parts by weight solvent per part by weight heavy oil or bitumen.

9. The process of claim 1 wherein the solvent comprises a hydrocarbon having 3 to 8 carbon atoms or a combination thereof.

10. The process of claim 1 wherein the solvent comprises a hydrocarbon having 4 to 7 carbon atoms or a combination thereof.

11. The process of claim 1 wherein the solvent comprises a hydrocarbon having 5 or 6 carbon atoms or a combination thereof.

12. The process of claim 1 wherein the heavy oil or bitumen is free of desalting upstream from the solvent deasphalting unit.

13. An integrated process for transporting and upgrading heavy oil or bitumen, comprising:

diluting the heavy oil or bitumen with a diluent comprising a hydrocarbon having from 3 to 8 carbon atoms to form a mixture;

transporting the mixture to a solvent deasphalting unit;

deasphalting the mixture in the solvent deasphalting unit to recover an asphaltene fraction, a deasphalted oil fraction essentially free of asphaltenes, and a solvent fraction;

separating water and salts from the asphaltene fraction, the deasphalted oil fraction, and the solvent fraction at the solvent deasphalting unit, wherein sour water and chloride salts are recovered from the deasphalted oil fraction rendering the deasphalted oil fraction essentially free of water and chloride salts; and recycling at least a portion of the solvent fraction to the heavy oil or bitumen as the diluent to form the mixture.

14. The integrated process of claim 13, further comprising injecting seed water into the mixture prior to the solvent deasphalting unit to facilitate salt removal.

15. The integrated process of claim 13, further comprising diluting the heavy oil or bitumen with the diluent at a production site for the heavy oil or bitumen.

* * * * *